US008327930B2

(12) United States Patent
Rondeau

(10) Patent No.: US 8,327,930 B2
(45) Date of Patent: Dec. 11, 2012

(54) EQUIPMENT FOR REMOTE LAUNCHING OF CEMENTING PLUGS

(75) Inventor: Joel Rondeau, Antony (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 221 days.

(21) Appl. No.: 12/879,052

(22) Filed: Sep. 10, 2010

(65) Prior Publication Data

US 2011/0067865 A1 Mar. 24, 2011

(30) Foreign Application Priority Data

Sep. 24, 2009 (EP) ..... 09290732

(51) Int. Cl.
*E21B 33/16* (2006.01)
*E21B 33/13* (2006.01)

(52) U.S. Cl. ..... 166/153; 166/285

(58) Field of Classification Search ..... 166/285, 166/291, 292, 119, 192, 202, 70, 153, 155, 166/156
See application file for complete search history.

(56) References Cited

U.S. PATENT DOCUMENTS

| | | | | |
|---|---|---|---|---|
| 3,616,850 | A | 11/1971 | Scott | |
| 3,863,716 | A | 2/1975 | Streich | |
| 4,042,014 | A | 8/1977 | Scott | |
| 4,574,882 | A | 3/1986 | Szarka | |
| 4,674,573 | A * | 6/1987 | Bode | 166/291 |
| 4,958,686 | A | 9/1990 | Putch | |
| 5,004,048 | A | 4/1991 | Bode | |
| 5,095,988 | A | 3/1992 | Bode | |
| 5,435,390 | A | 7/1995 | Baugh et al. | |
| 5,553,667 | A | 9/1996 | Budde et al. | |
| 5,590,713 | A | 1/1997 | Baugh et al. | |
| 5,787,979 | A | 8/1998 | Giroux et al. | |
| 5,813,457 | A | 9/1998 | Giroux et al. | |
| 5,833,002 | A | 11/1998 | Holcombe | |
| 5,890,537 | A | 4/1999 | Lavaure et al. | |
| 5,950,724 | A | 9/1999 | Giebeler | |
| 5,950,725 | A | 9/1999 | Rondeau et al. | |
| 6,056,053 | A | 5/2000 | Giroux et al. | |
| 6,799,638 | B2 | 10/2004 | Butterfield, Jr. | |
| 6,802,372 | B2 | 10/2004 | Budde | |
| 7,143,831 | B2 | 12/2006 | Budde | |
| 7,866,390 | B2 * | 1/2011 | Latiolais et al. | 166/285 |
| 2003/0141052 | A1 * | 7/2003 | Pedersen et al. | 166/70 |

(Continued)

FOREIGN PATENT DOCUMENTS

| | | |
|---|---|---|
| EP | 0500165 | 8/1992 |

(Continued)

OTHER PUBLICATIONS

Leugemors E, Metson J, Pessin J-L, Colvard RL, Krauss CD and Plante M: "Cementing Equipment and Casing Hardware," in Nelson EB and Guillot D (eds.): Well Cementing—2nd Edition, Houston: Schlumberger (2006): 343-434.

(Continued)

*Primary Examiner* — Daniel P Stephenson
(74) *Attorney, Agent, or Firm* — Matthias Abrell

(57) ABSTRACT

Apparatus and methods for remotely launching cementing plugs during the primary cementation of a subterranean well. The apparatus includes a flexible sleeve that absorbs force exerted by activation devices as they arrive at a cementing head, thereby preventing premature release of a cementing plug.

20 Claims, 2 Drawing Sheets

U.S. PATENT DOCUMENTS

| | | | | |
|---|---|---|---|---|
| 2003/0164237 | A1 | 9/2003 | Butterfield, Jr. | |
| 2004/0231836 | A1 | 11/2004 | Budde | |
| 2006/0027122 | A1 | 2/2006 | Arce et al. | |
| 2011/0067866 | A1* | 3/2011 | Rondeau et al. | 166/292 |
| 2011/0146986 | A1* | 6/2011 | Giem et al. | 166/291 |
| 2011/0240316 | A1* | 10/2011 | Rondeau | 166/386 |
| 2011/0290481 | A1* | 12/2011 | Rondeau et al. | 166/265 |
| 2012/0031614 | A1* | 2/2012 | Rondeau et al. | 166/293 |
| 2012/0090835 | A1* | 4/2012 | Kefi | 166/252.6 |

FOREIGN PATENT DOCUMENTS

| | | |
|---|---|---|
| EP | 0450676 | 6/1995 |
| EP | 1496193 | 1/2005 |
| EP | 1340882 | 10/2005 |
| WO | 94/28282 | 12/1994 |
| WO | 98/25004 | 6/1998 |
| WO | 99/24692 | 5/1999 |
| WO | 2006/014939 | 2/2006 |

OTHER PUBLICATIONS

Piot B and Cuvillier G: "Primary Cementing," in Nelson EB and Guillot D (eds.): Well Cementing—2nd Edition, Houston: Schlumberger (2006): 459-501.

Brandt W et al.: "Deepening the Search for Offshore Hydrocarbons." Oilfield Review (Spring 1998) 10, No. 1, 2-21.

* cited by examiner

EQUIPMENT FOR REMOTE LAUNCHING OF CEMENTING PLUGS

BACKGROUND OF THE INVENTION

The statements in this section merely provide background information related to the present disclosure and may not constitute prior art.

Some embodiments are related, in general. to equipment for servicing subterranean wells, and in particular, to apparatus and methods for remotely launching cementing plugs during the primary cementation of a subterranean well.

Most primary cementing treatments involve the use of wiper plugs that travel through the interior of a tubular body (e.g., casing or liner). When launched, the plugs travel from the top of the tubular body to the bottom, where they become seated. The purpose of the plugs is to separate and prevent commingling of different fluids during their journey through the tubular body. In most cases, operators deploy a bottom plug and a top plug.

After the tubular body is installed in the wellbore, the annulus between the tubular body and the wellbore wall (or another tubular body) is usually filled with drilling fluid. When the primary cementing treatment commences, the bottom plug is first launched into the tubular body, followed by the cement slurry. The cement slurry may be preceded by a spacer fluid, a chemical wash or both. The function of the bottom plug is to scrape traces of drilling fluid from the internal surface of the tubular body, and to prevent contact between the drilling fluid and the cement slurry.

The bottom-plug launching and conveyance through the tubular body arises from pressure applied by the cement slurry. When the bottom plug completes its journey through the tubular body, it becomes seated on float equipment installed at the bottom of the tubular body. Continued pumping exerts sufficient pressure to rupture a membrane at the top of the bottom plug, allowing the cement slurry to flow through an interior passage in the bottom plug, exit the bottom of the tubular body and continue into the annulus.

After sufficient cement slurry to fill the annulus has been pumped into the tubular body, the top plug is launched into the tubular body, and a displacement fluid is pumped behind the plug. The displacement fluid forces the plug through the tubular body. The function of the top plug is to scrape traces of cement slurry from the internal surface of the tubular body, isolate the cement slurry from the displacement fluid and, upon landing on the bottom plug, seal the tubular body interior from the annulus. Unlike the bottom plug, the top plug has no membrane or interior passage through which fluids may flow.

A thorough description of the primary cementing process and the equipment employed to perform the service may be found in the following references. (1) Piot B. and Cuvillier G.: "Primary Cementing," in Nelson E. B. and Guillot D. (eds.): *Well Cementing*—$2^{nd}$ Edition, Houston: Schlumberger (2006): 459-501. (2) Leugemors E., Metson J., Pessin J.-L., Colvard R. L., Krauss C. D. and Plante M.: "Cementing Equipment and Casing Hardware," in Nelson E. B. and Guillot D. (eds.): *Well Cementing*—$2^{nd}$ Edition, Houston: Schlumberger (2006): 343-434.

Wiper plugs are usually launched from a cementing head that is attached to the tubular body near the drilling rig. The tubular body rises from the bottom of the openhole to the rig floor. However, for subsea completions, the problem becomes more complicated, and fluid isolation becomes more and more critical as water depth increases. It thus becomes impractical to launch wiper plugs from the surface. Therefore, the cementing head containing the wiper plugs rests on the seafloor, and the top of the tubular body ends at the mudline. Drillpipe connects the top of the tubular body to the rig floor on the surface. During the cementing process, darts are released into the drillpipe on surface, travel through the drillpipe to the seafloor and, upon arrival, trigger the release of the wiper plugs.

After the first dart is launched, cement slurry is pumped behind it. When the first dart lands inside the cementing head, the bottom plug is released. The second dart is launched after sufficient cement slurry has been pumped to fill the annulus. A displacement fluid is pumped behind the second dart pressure indicates when each wiper plug has been launched. This process is detailed in the following references: (1) Buisine P. and Lavaure G.: "Equipment for Remote Launching of Cementing Plugs into Subsea Dr. When the second dart arrives, the top plug is released. A brief peak in surface illed Wells," European Patent Application 0 450 676 A1 (1991); (2) Brandt W. et al.: "Deepening the Search for Offshore Hydrocarbons." *Oilfield Review* (Spring 1998) 10, No. 1, 2-21.

Those skilled in the art will understand that process fluids may comprise drilling fluids, cement slurries, chemical washes, spacer fluids and completion fluids.

A disadvantage of the subsea plug launching mechanism currently used in the art is that, other than controlling the process-fluid pump rate, the operator has little control of the force exerted by the dart when landing inside the cementing head. If the dart exerts excessive force upon arrival inside the cementing head, the dart may travel too far, resulting in the premature release of the top plug. Such an occurrence could result in cement slurry being left inside the tubular body—a condition known as "cement left in pipe" or CLIP.

It remains desirable, therefore, to provide an improved apparatus and methods that would prevent premature release of the top plug resulting from improper function of the bottom dart.

SUMMARY OF THE INVENTION

The first aspect is an apparatus that allows control of the force exerted by a dart upon arrival inside a cementing head.

The second aspect is a method for launching cementing plugs during a primary cementing operation.

The third aspect is a method for cementing a subterranean well.

All aspects may be applied in oil and gas wells, geothermal wells, water wells, and wells for chemical waste disposal, enhanced recovery of hydrocarbons and carbon sequestration.

DETAILED DESCRIPTION

When cementing the annular space between tubulars and the walls of a subterranean wellbore, it is usually necessary to minimize or prevent the commingling of the drilling fluid, spacer fluid and cement slurry. Commingling may result, for example, in adverse rheological effects, dilution of the cement slurry and compromised zonal isolation. One way to minimize commingling involves using wiper plugs to separate fluids as they travel down the tubulars. Wiper plugs also clean the inner surface of the tubulars. Most cementing operations involve two wiper plugs: a bottom plug that separates cement slurry from drilling fluid, and a bottom plug that separates cement slurry from displacement fluid. The bottom plug travels through the tubular body (e.g., casing) and lands on float equipment at the bottom end. Continued pumping breaks a membrane in the bottom plug, allowing cement slurry to pass through the plug and enter the annular region around the tubular body. The top plug lands on top of the bottom plug, forcing the cement slurry out of the tubular-body interior, and leaving the tubular-body interior full of displacement fluid. Premature release of the top plug can result in the failure to pump all of the cement slurry out of the tubular body, and incomplete filling of the annular region around the outside of the tubular body. Premature top-plug release can occur when the bottom dart exerts excessive force upon landing inside the cementing head and travels too far downward inside the cementing head.

Some embodiments provide apparatus and methods by which premature release of the top plug may be prevented.

Figure 1A:
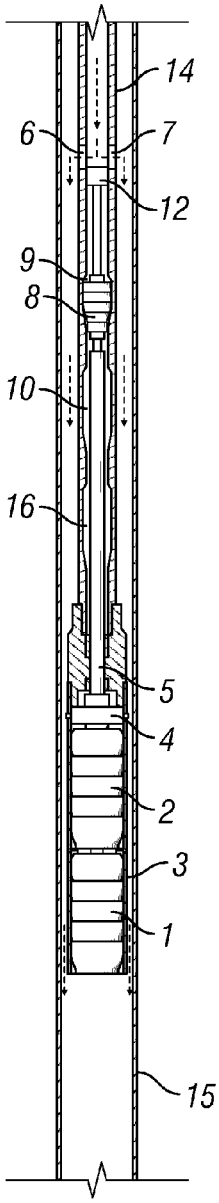
FIGS. 1A-1E illustrate the design and operation of the invention.
Figure 1B:
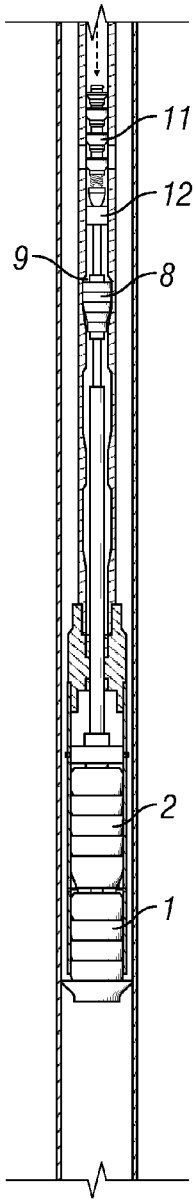
Figure 1C:
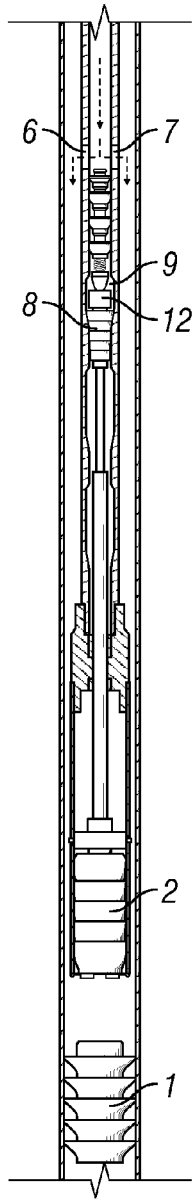
Figure 1D:
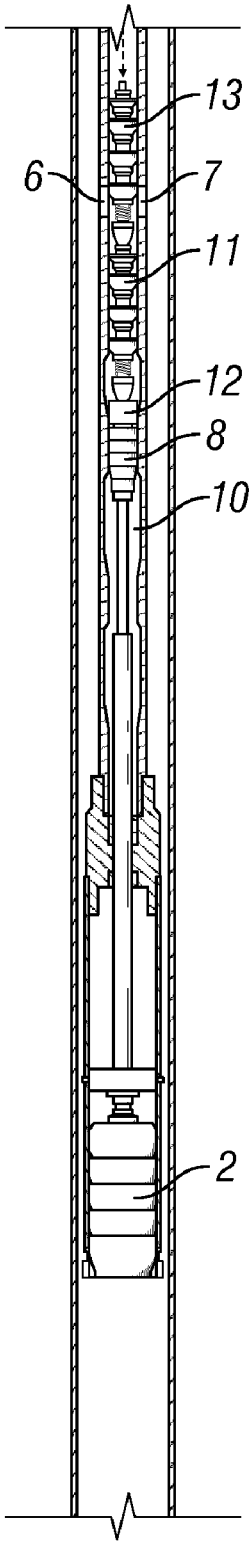
Figure 1E:
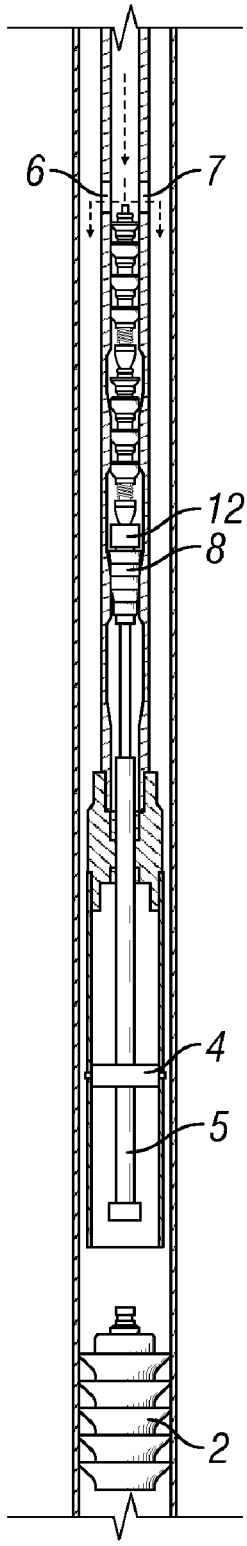

The first aspect is an apparatus that allows control of the force exerted by a dart upon arrival inside a cementing head. The apparatus is shown in FIG. 1. The apparatus comprises three portions. The first portion comprises the following elements. A bottom plug 1 and a top plug 2 are located inside a plug basket 3. A piston 4, located above the plug basket 3, is driven by a main rod 5, equipped with a rod head 12. Between the piston 4 and the rod head 12, a flexible sleeve 8 is installed around the rod 5. The flexible sleeve may, without limitation, be fabricated from rubber or another elastomer. The flexible sleeve is initially located inside a first braking chamber 9. Below the first braking chamber 9 is a second braking chamber 10. The apparatus comprises at least two braking chambers. The apparatus shown in FIG. 1 includes a third braking chamber 14, allowing the use of a third cementing plug if desired. The braking chambers are tapered such that the flexible sleeve 8 must become compressed in order to move downward and exit a braking chamber. Above the rod head 12, there are ports 6 and 7 in a tubular body 14, through which wellbore-service fluids may flow. This first portion of the apparatus is initially installed inside another tubular body 15.

The second portion of the apparatus is a bottom dart 11. The third portion of the apparatus is a top dart 13. Both the second and third portions are initially separated from the first portion.

The second aspect is a method for launching cementing plugs during a primary cementing operation.

As apparent from FIG. 1, the first portion of the apparatus described in the first aspect is preferably installed inside a casing string 15. A first process fluid is pumped from the surface through tubular body 14. As shown in Step A, process fluid initially flows through ports 6 and 7, bypassing the rest of the first portion of the apparatus. A bottom dart 11 is launched into the process fluid stream in the tubular body 14. A second process fluid is pumped behind the bottom dart 11. After a desired volume of second process fluid has been pumped into the well, a top dart 13 is launched into the process fluid stream in the tubular body 14, followed by a third process fluid.

Step B depicts the moment during which the bottom dart 11 lands on rod head 12, installed on main rod 5. Fluid flow through ports 6 and 7 is blocked by the bottom dart 11. Further pumping of process fluid forces the bottom dart downward, thereby forcing the rod 5 downward, thereby causing the piston 4 to move downward and eject the bottom plug 1 from the plug basket 3. The bottom plug 1 acts as a barrier between the first and second process fluids, preventing their commingling while traveling through the interior of the casing 15.

Step C shows the moment during which the rod head 12 lands on the flexible sleeve 8. The first tapered braking chamber 9 restricts downward movement of the flexible sleeve 8; as a result, the flexible sleeve compresses, thereby absorbing the downward energy exerted by the bottom dart 11. Clearance of the bottom dart 11 past ports 6 and 7 reestablishes process-fluid flow outside the apparatus.

In Step D, the top dart 13 has landed on the bottom dart 11, obstructing fluid flow through ports 6 and 7. Further pumping causes the top dart 13 to move downward, forcing the bottom dart 11 and rod head 12 to follow suit. The downward force causes the flexible sleeve 8 to compress once again; however, this time the flexible sleeve compresses to a sufficient extent that it exits the first braking chamber 9 and begins moving into the second braking chamber 10.

Step E shows that, once the flexible sleeve 8 has become lodged inside the second braking chamber 10, the rod 5 has cleared the piston 4 and forced the top plug 2 out of the plug basket 3. The top dart has cleared ports 6 and 7, and process-fluid flow outside the apparatus is restored. The top plug 2 acts as a barrier between the second and third process fluids, preventing their commingling while traveling through the interior of the casing 15. When the top plug 2 lands on the bottom plug 1, the region in the wellbore surrounding the casing 15 is filled with second process fluid, the interior of the casing is filled with third process fluid, and the interior of the casing is isolated from the annulus.

It will be understood by those skilled the art that the internal volume of the tubular body 14 may be less than the amount of second process fluid necessary to fill the annular region surrounding the casing 15. In such cases, the second portion of the first aspect, the bottom dart 11, will reach the first portion of the first aspect before the desired quantity of process fluid has been pumped into the tubular body 14. Thus, the bottom plug 1 may be launched before the top dart 13 is launched.

The third aspect is a method for cementing a subterranean well.

The first portion of the apparatus described in the first aspect is installed inside a casing string 15. Drilling fluid is pumped from the surface through tubular body 14. As shown in Step A, drilling fluid initially flows through ports 6 and 7, bypassing the rest of the first portion of the apparatus. A bottom dart 11 is launched into the drilling-fluid stream in the tubular body 14. A cement slurry is pumped behind the bottom dart 11. The cement slurry may be preceded by a spacer fluid, a chemical wash, or both. After a desired volume of cement slurry has been pumped into the well, a top dart 13 is launched into the cement slurry in the tubular body 14, followed by a displacement fluid which may include (but not be limited to) drilling fluid and a completion fluid.

Step B depicts the moment during which the bottom dart 11 lands on rod head 12, installed on main rod 5. Fluid flow through ports 6 and 7 is blocked by the bottom dart 11. Further pumping forces the bottom dart downward, thereby forcing the rod 5 downward, thereby causing the piston 4 to move downward and eject the bottom plug 1 from the plug basket 3 into the casing 15. The bottom plug 1 travels through the casing 15 and lands on float equipment at the bottom of the casing string. The bottom plug 1 acts as a barrier between the drilling fluid and the cement slurry, preventing their commingling while traveling through the interior of the casing 15.

Step C shows the moment during which the rod head 12 lands on the flexible sleeve 8. The first tapered braking chamber 9 restricts downward movement of the flexible sleeve 8; as a result, the flexible sleeve compresses, thereby absorbing the downward energy exerted by the bottom dart 11. Clearance of the bottom dart 11 past ports 6 and 7 reestablishes fluid flow outside the apparatus.

In Step D, the top dart 13 has landed on the bottom dart 11, obstructing fluid flow through ports 6 and 7. Further pumping causes the top dart 13 to move downward, forcing the bottom dart 11 and rod head 12 to follow suit. The downward force causes the flexible sleeve 8 to compress once again; however, this time the flexible sleeve compresses to a sufficient extent that it exits the first braking chamber 9 and begins moving into the second braking chamber 10.

Step E shows that, once the flexible sleeve 8 has become lodged inside the second braking chamber 10, the rod 5 has cleared the piston 4 and forced the top plug 2 out of the plug basket 3. The top dart has cleared ports 6 and 7, and process-fluid flow outside the apparatus is restored. The top plug 2 travels through the casing 20 and lands on the bottom plug 1 at the bottom of the casing string. The top plug 2 acts as a barrier between the cement slurry and the displacement fluid, preventing their commingling while traveling through the interior of the casing 15. When the top plug 2 lands on the bottom plug 1, the region in the wellbore surrounding the casing 15 is filled with cement slurry, the interior of the casing is filled with displacement fluid, and the interior of the casing is isolated from the annulus.

It will be understood by those skilled in the art that the internal volume of the tubular body 14 may be less than the amount of cement slurry necessary to fill the annular region surrounding the casing 15. In such cases, the second portion of the first aspect, the bottom dart 11 will reach the first portion of the first aspect before the desired quantity of process fluid has been pumped into the tubular body 14. Thus, the bottom plug 1 may be launched before the top dart 13 is launched.

In all aspects the flexible sleeve preferably comprises (but is not limited to) an elastomer. The elastomer may comprise one or more members of the list comprising: natural rubber, polyisoprene, butyl rubber, polybutadiene, styrene-butadiene rubber, nitrile rubber, chloroprene rubber, ethylene propylene rubber, ethylene propylene diene rubber, epichlorohydrin rubber, polyacrylic rubber, silicone rubber, fluorosilicone rubber, fluoroelastomers, perfluoroelastomers, polyether block amides, chlorosulfonated polyethylene, and ethylene-vinyl acetate The most preferred elastomer is natural rubber. However, those skilled in the art will appreciate that it is necessary to choose an elastomer that would be stable at the temperatures it would encounter downhole; more generally, an elastomer or a mixture of elastomer that would perform satisfactorily at conditions encountered downhole.

All aspects may be applied in oil and gas wells, geothermal wells, water wells, and wells for chemical waste disposal, enhanced recovery of hydrocarbons and carbon sequestration.

The preceding description has been presented with reference to some embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

I claim:

1. A system for launching cementing plugs in a subterranean well, wherein at least a bottom plug and a top plug are launched from a plug basket by an arrangement comprising:

i. a first portion, comprising:

(a) a plug basket that initially contains at least a bottom plug and a top plug;

(b) a piston above the plug basket, initially connected to a main rod;

(c) a rod head installed on the main rod;

(d) a flexible sleeve installed around the main rod between the piston and the rod head;

(e) at least two braking chambers comprising a first braking chamber and a second braking chamber;

(f) ports in a first tubular body through which wellbore-service fluids may flow; and ii. a second portion, comprising a bottom dart; and iii. a third portion, comprising a top dart.

2. The system of claim 1, wherein the system further comprises a third braking chamber.

3. The system of claim 2, wherein the flexible sleeve is made of an elastomer.

4. The system of claim 3, wherein the elastomer comprises one or more members of the list comprising: natural rubber, polyisoprene, butyl rubber, polybutadiene, styrene-butadiene rubber, nitrile rubber, chloroprene rubber, ethylene propylene rubber, ethylene propylene diene rubber, epichlorohydrin rubber, polyacrylic rubber, silicone rubber, fluorosilicone rubber, fluoroelastomers, perfluoroelastomers, polyether block amides, chlorosulfonated polyethylene, and ethylene-vinyl acetate.

5. The system of claim 1, wherein the flexible sleeve is made of an elastomer.

6. The system of claim 5, wherein the elastomer comprises one or more members of the list comprising: natural rubber, polyisoprene, butyl rubber, polybutadiene, styrene-butadiene rubber, nitrile rubber, chloroprene rubber, ethylene propylene rubber, ethylene propylene diene rubber, epichlorohydrin rubber, polyacrylic rubber, silicone rubber, fluorosilicone rubber, fluoroelastomers, perfluoroelastomers, polyether block amides, chlorosulfonated polyethylene, and ethylene-vinyl acetate.

7. The system of claim 1, wherein the subterranean well is a member of the list comprising: an oil well, a gas well, a geothermal well, a water well, a well for chemical-waste disposal, a well for enhanced recovery of hydrocarbons and a well for carbon sequestration.

8. A method for launching cementing plugs in a subterranean well, wherein at least a bottom plug and a top plug are launched by an arrangement comprising:

i. installing a system inside a second tubular body, the system comprising:

(a) a plug basket that initially contains at least a bottom plug and a top plug;

(b) a piston above the plug basket, initially connected to a main rod;

(c) a rod head installed on the main rod;

(d) a flexible sleeve installed around the main rod between the piston and the rod head;

(e) at least two braking chambers comprising a first braking chamber and a second braking chamber; and (f) ports in a first tubular body through which wellbore-service fluids may flow;

ii. pumping process fluid through the first tubular body inside the second tubular body, and allowing the fluid to flow through the ports;

iii. launching a bottom dart into the process-fluid stream inside the first tubular body;

iv. pumping a desired volume of process fluid behind the bottom dart;

v. launching a top dart into the process-fluid stream inside the first tubular body;

vi. pumping process fluid behind the top dart;

vii. continuing to pump process fluid until the bottom dart lands on a rod head on a main rod, blocking fluid flow through the flow ports;

viii. continuing to pump process fluid until the bottom dart clears the ports, causing the rod head to move downward until it lands on a flexible sleeve situated inside the first braking chamber, causing the flexible sleeve to compress and absorb downward force exerted by the bottom dart, causing a piston to move downward, thereby forcing the bottom plug to exit the plug basket;

ix. continuing to pump process fluid until the top dart lands on the bottom dart, blocking fluid flow through the ports;

x. continuing to pump process fluid until the top dart clears the ports, thereby causing the bottom dart and rod head to move downward, thereby causing the flexible sleeve to compress to a sufficient extent that it exits the first braking chamber and enters the second braking chamber, thereby absorbing downward force exerted by the top dart, thereby allowing the main rod to pass through the piston, thereby forcing the top plug to exit the plug basket.

9. The method of claim 8, wherein the interior volume of the first tubular body is less than the volume of second process fluid necessary to fill the annular region surrounding the first tubular body, resulting in the launch of the bottom plug before the launch of the top dart.

10. The method of claim 8, wherein the flexible sleeve is made of an elastomer.

11. The method of claim 10, wherein the elastomer comprises one or more members of the list comprising: natural rubber, polyisoprene, butyl rubber, polybutadiene, styrene-butadiene rubber, nitrile rubber, chloroprene rubber, ethylene propylene rubber, ethylene propylene diene rubber, epichlorohydrin rubber, polyacrylic rubber, silicone rubber, fluorosilicone rubber, fluoroelastomers, perfluoroelastomers, polyether block amides, chlorosulfonated polyethylene, and ethylene-vinyl acetate.

12. The method of claim 8, wherein the process fluid is preceded by a spacer fluid, a chemical wash or both.

13. The method of claim 8, wherein the subterranean well is a member of the list comprising: an oil well, a gas well, a geothermal well, a water well, a well for chemical-waste disposal, a well for enhanced recovery of hydrocarbons and a well for carbon sequestration.

14. A method for cementing a subterranean well, wherein at least a bottom plug and a top plug are launched by an arrangement comprising:

i. installing a system inside a second tubular body, the system comprising:

(a) a plug basket that initially contains at least a bottom plug and a top plug;

(b) a piston above the plug basket, initially connected to a main rod;

(c) a rod head installed on the main rod;

(d) a flexible sleeve installed around the main rod between the piston and the rod head;

(e) at least two braking chambers comprising a first braking chamber and a second braking chamber; and (f) ports in a first tubular body through which wellbore-service fluids may flow;

ii. pumping drilling fluid through the first tubular body inside the second tubular body, and allowing the fluid to flow through the ports;

iii. launching a bottom dart into the drilling-fluid stream inside the first tubular body;

iv. pumping a desired volume of cement slurry behind the bottom dart;

v. launching a top dart into the cement-slurry stream inside the first tubular body;

vi. pumping displacement fluid behind the top dart;

vii. continuing to pump until the bottom dart lands on a rod head on a main rod, blocking fluid flow through the ports;

viii. continuing to pump until the bottom dart clears the ports, causing the rod head to move downward until it lands on a flexible sleeve situated inside the first braking chamber, causing the flexible sleeve to compress and absorb downward force exerted by the bottom dart, causing a piston to move downward, thereby forcing the bottom plug to exit the plug basket;

ix. continuing to pump until the top dart lands on the bottom dart, blocking fluid flow through the ports;

x. continuing to pump until the top dart clears the ports, thereby causing the bottom dart and rod head to move downward, thereby causing the flexible sleeve to compress to a sufficient extent that it exits the first braking chamber and enters the second braking chamber, thereby absorbing downward force exerted by the top dart, thereby allowing the main rod to pass through the piston, thereby forcing the top plug to exit the plug basket; and xi. continuing to pump until the top plug lands on float equipment at the bottom of the first tubular body.

15. The method of claim 14, wherein the interior volume of the first tubular body is less than the volume of cement slurry necessary to fill the annular region surrounding the first tubular body, resulting in the launch of the bottom plug before the launch of the top dart.

16. The method of claim 14, wherein the cement slurry is preceded by a spacer fluid, a chemical wash or both.

17. The method of claim 14, wherein the flexible sleeve is made of an elastomer.

18. The method of claim 17, wherein the elastomer comprises one or more members of the list comprising: natural rubber, polyisoprene, butyl rubber, polybutadiene, styrene-butadiene rubber, nitrile rubber, chloroprene rubber, ethylene propylene rubber, ethylene propylene diene rubber, epichlorohydrin rubber, polyacrylic rubber, silicone rubber, fluorosilicone rubber, fluoroelastomers, perfluoroelastomers, polyether block amides, chlorosulfonated polyethylene, and ethylene-vinyl acetate.

19. The method of claim 18, wherein the elastomer is stable at downhole temperature.

20. The method of claim 14, wherein the subterranean well is a member of the list comprising: an oil well, a gas well, a geothermal well, a water well, a well for chemical-waste disposal, a well for enhanced recovery of hydrocarbons and a well for carbon sequestration.

* * * * *